United States Patent [19]

Anderson

[11] Patent Number: 4,633,635

[45] Date of Patent: Jan. 6, 1987

[54] PANEL INSTALLATION CLIP

[75] Inventor: Richard N. Anderson, Owensboro, Ky.

[73] Assignee: Hunter Douglas, Inc., Totowa, N.J.

[21] Appl. No.: 624,182

[22] Filed: Jun. 25, 1984

Related U.S. Application Data

[63] Continuation-in-part of Ser. No. 516,093, Jul. 22, 1983, abandoned.

[51] Int. Cl.[4] ..... E04B 5/52

[52] U.S. Cl. ..... 52/489; 52/713

[58] Field of Search ..... 52/480, 486, 489, 709, 52/711, 713, 762; 16/93 R

[56] References Cited

U.S. PATENT DOCUMENTS

| | | | |
|---|---|---|---|
| 1,881,836 | 10/1932 | Mitchell | 24/458 X |
| 1,993,792 | 3/1935 | Manske et al. | 52/346 |
| 1,997,581 | 4/1935 | Heeren et al. | 52/489 X |
| 2,312,673 | 3/1943 | Rizzolo | 52/489 X |
| 3,209,505 | 10/1965 | Vermeulen et al. | 52/489 |
| 3,295,284 | 1/1967 | Tschiesche | 52/484 X |
| 3,640,033 | 2/1972 | Rijnders | 52/665 X |
| 3,998,018 | 12/1976 | Hodges | 52/489 X |
| 4,494,346 | 1/1985 | Gailey | 52/489 |

*Primary Examiner*—William F. Pate, III
*Assistant Examiner*—Jean M. LaKemper
*Attorney, Agent, or Firm*—Pennie & Edmonds

[57] ABSTRACT

A panel installation clip for securing a panel to a carrier. The clip has a base part and a panel engaging part rotatably supported by the base part. The base part includes connecting members for fastening the clip to a carrier while the panel engaging part includes connecting members for engaging and supporting a panel.

11 Claims, 14 Drawing Figures

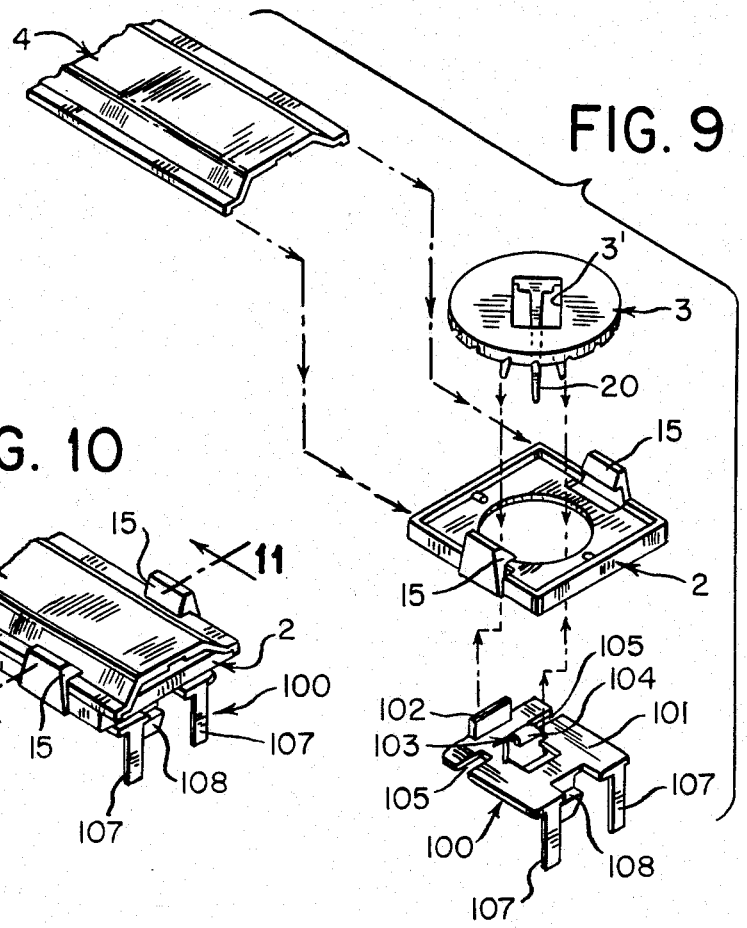
FIG. 9
FIG. 10
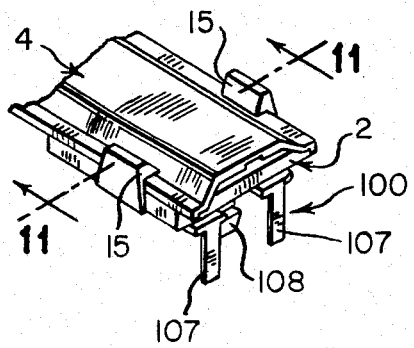
FIG. 11
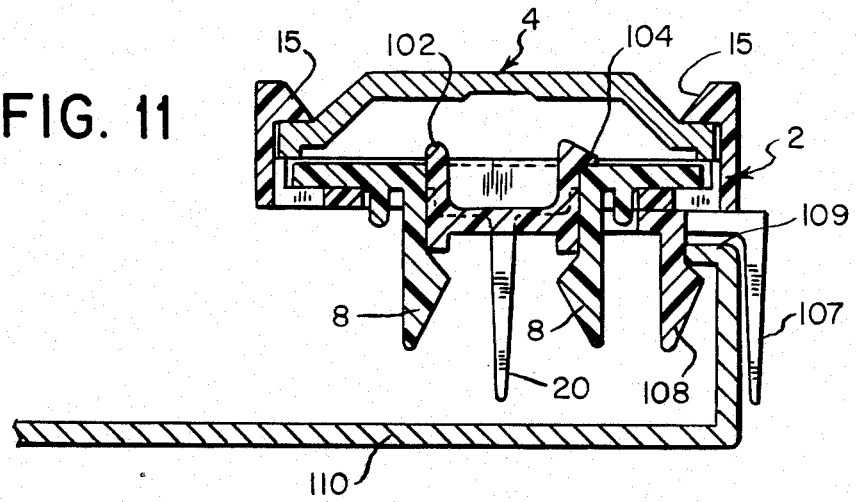

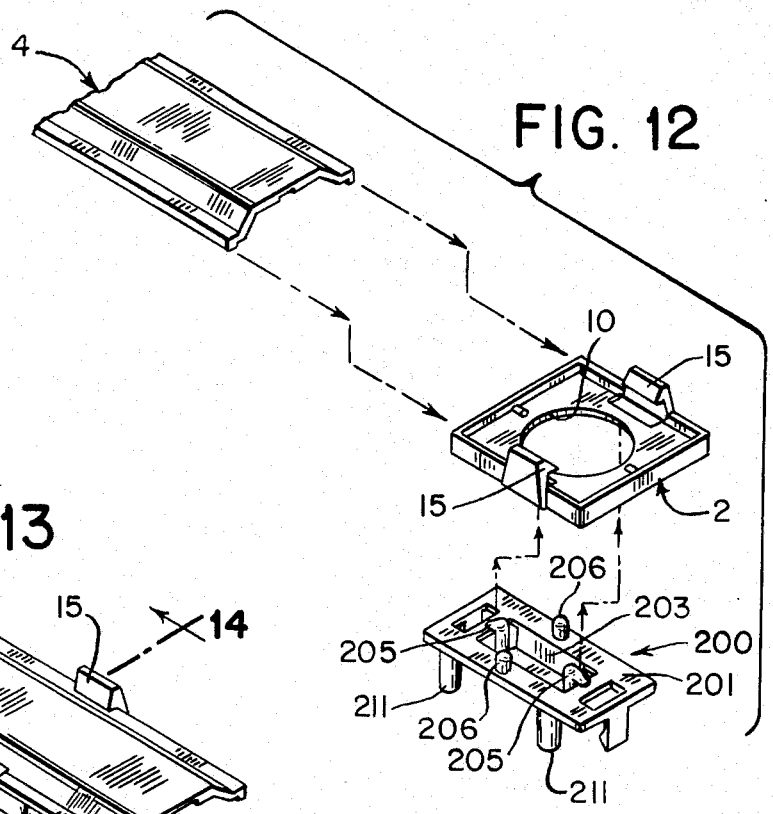
FIG. 12
FIG. 13
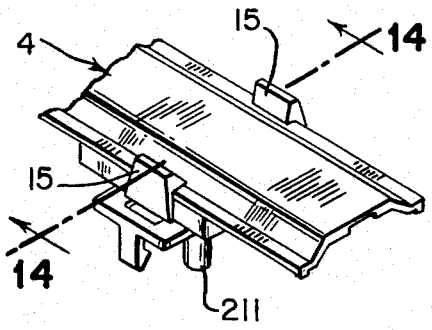
FIG. 14
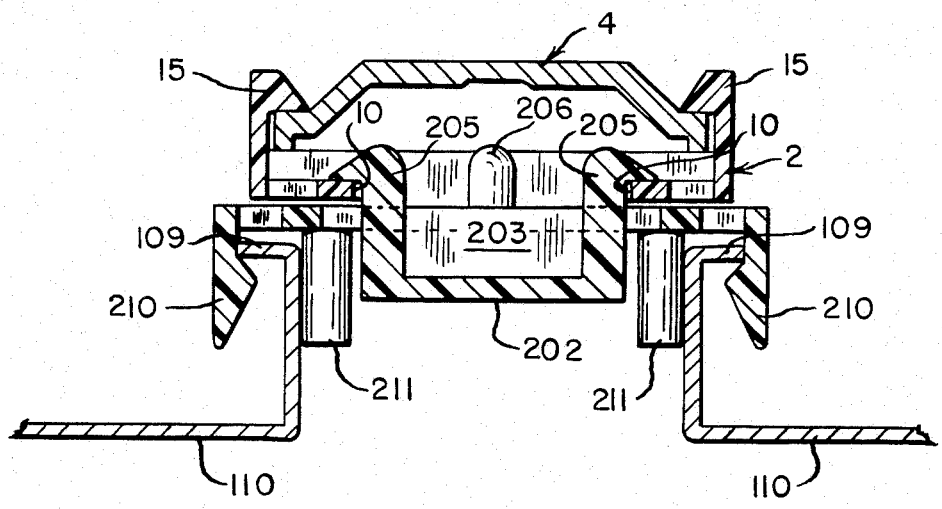

PANEL INSTALLATION CLIP

CROSS-REFERENCE TO OTHER APPLICATIONS

This application is a continuation-in-part of my copending application Ser. No. 516,093, filed July 22, 1983, now abandoned.

FIELD OF THE INVENTION

This invention relates to a panel installation clip and more particularly to a clip by which a panel may be supported in a desired angular relationship with respect to a supporting carrier.

BACKGROUND OF THE INVENTION

Ceiling panels are conventionally supported by carriers which usually extend perpendicular to the panels and where the carriers in turn are suspended from a ceiling structure. The panels are usually connected to the carrier by a variety of means including clips which securely fasten the panels to the carriers. If the ceiling panels are to extend in a particular direction, then it is a requirement that the carrier extend perpendicularly to the panels. Often however, because of building design or because of vents, piping, ducting or other structure positioned in the spacing between the ceiling structure and the paneling, it is difficult to assure that the carriers will always extend perpendicularly to the panels. In such instances, it may be of an advantage that the panels extend at an angle other than 90° with respect to other supporting carriers.

In other instances, in particular for ornamental purposes, it may be desirable to have different panels in the same room extend at different angles with respect to each other, and consequently, with respect to their supporting carriers.

It is difficult however to provide for any flexibility in the angular relationship between panels and supporting carriers since the clips or other means fastening a panel to a carrier are only constructed to fasten panels to carriers that extend at right angles or at another set angle with respect to each other.

It is further desirable in installing ceiling panels that end panels which are adapted to be positioned next to a wall fit closely to the wall in order to avoid any unsightly gap. This requires that any clip securing the panel to a carrier have a minimum of structure extending into any space between the end panel and the wall.

Further it is sometimes desirable when installing panels that spacing between adjacent panels be such that the resultant installation will have even modules, that is to say that the panels are installed at even intervals, for example, 4", 6" or 8". Since panels customarily come in widths of 3⅛", 5⅛" or 7⅛" spacing between adjacent panels should be ⅞" to give even module installation.

It is therefore an object of my invention to provide for a panel installation clip by which panels may be fastened to supporting carriers throughout a wide range of angles. It is a further object to provide for a clip that may be easily installed onto a carrier and to which conventional standard panels may be easily and securely locked.

It is a further object of my invention to provide for a panel installation clip construction which is adaptable for use with end panels of a plurality of adjacent panels whereby the end of the end panel may be installed close to a wall.

It is a still further object of the invention to provide for a clip construction whereby spacing between adjacent panels will result in adjacent panels being spaced to provide an even module panel installation.

DESCRIPTION OF THE INVENTION

Broadly a panel installation clip constructed according to my invention includes a base part which is adapted to engage with and to be supported from a carrier. The base part rotatably supports a panel engaging part which in turn is adapted to retain longitudinal rims of adjacent panels.

The panel engaging part preferably includes a bearing portion, for example a flange, that engages a bearing surface of the base part such that the surface rotatably supports the panel engaging part.

Preferably the base part has upstanding edges extending from the surface which surrounds the bearing portion and where the upstanding edges are of a height substantially equal to the thickness of the bearing portion. In this manner when the clip is applied to a carrier, any play between the panel engaging part and the carrier in the direction parallel to the axis of rotation of the panel engaging part is substantially eliminated. In some instances it may be even desirable to have the upstanding edges of a height slightly less than that of the bearing portion so that the bearing portion will contact the carrier to provide some frictional resistance against rotation of the bearing portion.

The base part has oppositely projecting spaced resilient hook members which are adapted to hook onto and engage opposite flanges of a carrier. The bearing portion of the panel engaging part is adapted to be snapped into place between the resilient hook members such that the base part may be held together with respect to the panel engaging part.

The panel engaging part has an elastic hook means connecting with the bearing portion and which extends through an aperture contained in the base part. This elastic hook means is adapted to connect with and support a longitudinal rim of a panel such as formed by an inturned end of a leg of a U-shaped panel. An intermediate flange is associated with the elastic hook means and is adapted to lock a rim of a panel between it and the hook means to securely lock the panel with respect to the clip. This intermediate flange is preferably elastic such that it may be bent sideways on application by pressure of a longitudinal rim when a rim is inserted between the flange and a hook means to provide an additional locking force on the rim and to insure that the rim always engages the hook means.

The hook means may include an upwardly inclined barb which is adapted to engage an edge of a rim and which, when engaged by a rim of larger than normal size, may be bent so that the inclined barb approaches a horizontal plane to provide a horizontal surface supporting the inturned edge. This construction is particularly adaptable for use when a panel has a horizontally extending inturned edge.

The hook means further preferably includes two oppositely disposed hooks with at least one inturned flange positioned on a plane extending midway between the hooks and preferably two such flanges. In this manner the clip may securely lock with and support longitudinal rims of two adjacent panels.

The panel installation clip may also take the form where the panel engaging part has oppositely disposed elastic support means which extend through the aperture contained in the base part and engage over the edges of the aperture so that the panel engaging part is supported relative to the base part. The panel engaging part has two spaced intermediate flanges extending parallel and in opposite directions from the elastic support means and a hook means associated with each intermediate flange and spaced outwardly therefrom. The space between each flange and its associated hook means is adapted to connect with and support a longitudinal rim of a panel and where the spacing between the intermediate flanges is such as to provide even module spacing of adjacent panels.

The panel installation clip may also include an adapter which may be connected to a panel engaging part when the panel engaging part is not engaging a panel. The adapter includes an intermediate flange at one end thereof and a resilient hook member spaced inwardly from the flange with the space between the flange and hook member adapted to receive and support a rim of an end panel of a plurality of adjacent panels. Since the flange is positioned on the end of the adapter, the flange may abut against a wall such that the only gap between the wall and end panel will be due to the thickness of the flange.

The base part and panel engaging part are both conveniently made of a plastic material by molding procedures. They could however be formed of metal leg stamping and bending procedures.

BRIEF DESCRIPTION OF THE DRAWINGS

FIG. 9 is an exploded perspective view of the clip construction of FIG. 1 including an end panel clip adapter for engaging and supporting an end panel;

FIG. 10 is a perspective view of the construction of FIG. 9 in assembled relation;

FIG. 11 is an enlarged sectional view of FIG. 10 taken along lines 11—11 showing the adapter clip engaging an end panel;

FIG. 12 is an exploded perspective view of a clip construction to achieve even module spacing of panels;

FIG. 13 is a perspective view of the construction shown in FIG. 12 in assembled relation; and, FIG. 14 is an enlarged sectional view of FIG. 13 taken along lines 14–14 illustrating the clip engaging and supporting longitudinal rims of adjacent panels.

DESCRIPTION OF THE PREFERRED MODE

Figure 1:
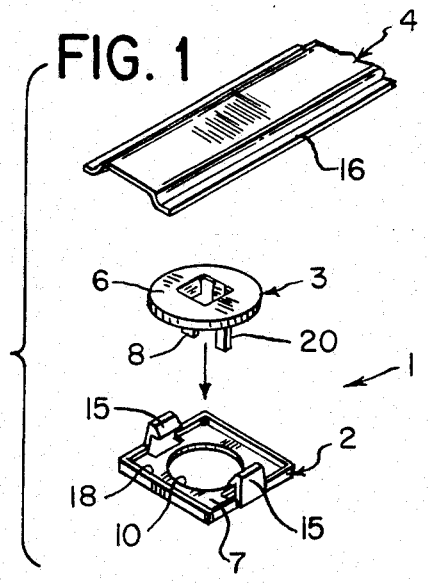
FIG. 1 is an exploded perspective view of a disassembled clip constructed according to the invention prior to fastening onto a carrier.
Figure 2:
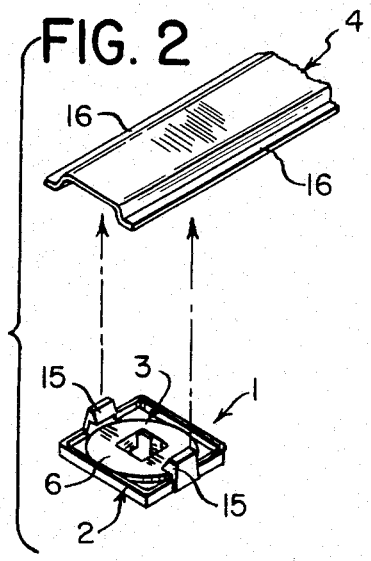
FIG. 2 is a view similar to FIG. 1 showing the clip in assembled relation.

Referring to FIG. 1 there is illustrated a clip 1 comprising a base part 2 and a panel engaging part 3 prior to being assembled together and prior to being fastened to a conventional carrier 4. FIG. 2 shows the parts 2 and 3 assembled together to form the clip and FIG. 3 shows the clip fastened onto the carrier 4.

Figure 4:
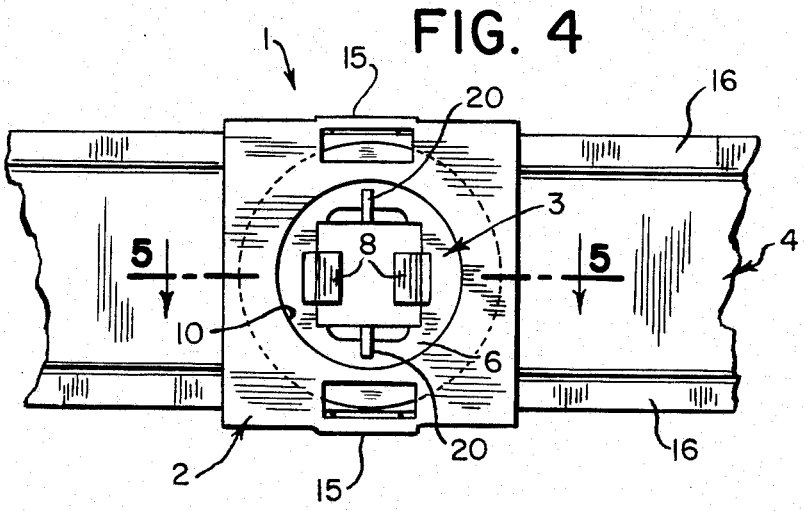
FIG. 4 is an enlarged bottom view of FIG. 3.
Figure 5:
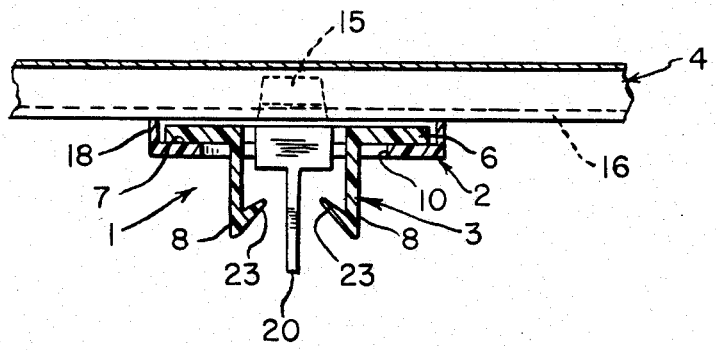
FIG. 5 is a cross-sectional view of FIG. 4 taken along lines 5—5.

As shown in FIGS. 4 and 5 the panel engaging part 3 has a bearing portion 6 in the form of an annular flange which is rotatably supported by a bearing surface 7 contained on the base part 2. The panel engaging part also has depending elastic hook means 8 which extend through an aperture 10 contained in the base part, and which, as explained in greater detail hereafter, are adapted to engage longitudinal rims of adjacent panels.

Figure 3:
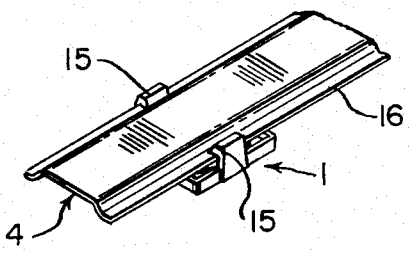
FIG. 3 is a view similar to FIG. 2 illustrating the assembled clip engaged with a carrier.

The base part has oppositely projecting spaced resilient or elastic hook members 15 adapted to engage opposite flanges 16 of a carrier 4 as shown in FIG. 3. The base part is connected to the carrier simply by forcing the base part upwardly against the flanges to spread the hook members until the flanges move beyond the hook portions of the hook members after which the hook members will snap back to securely lock the base part with respect to the flanges.

As shown in FIGS. 1 and 2 the bearing portion 6 is of a slightly greater diameter than the distance between the inwardly facing tips of the hook members 15 so that the panel engaging portion may be snapped into place with the base part. This allows the two parts comprising the clip to be joined together as a unit which can then be secured to a carrier.

Referring to FIG. 5 the base part is shown having an upstanding edge 18 on its periphery which is of slightly greater height than the thickness of the bearing portion or flange 6. When the assembled clip is secured to a carrier, the edge 18 will contact the lower surface of the carrier and limit the amount of any play in a direction parallel to the axis of rotation of the panel engaging part with respect to the base part. In some instances it may be desirable to limit ease of rotation of the bearing portion. This can be accomplished by making the height of the upstanding edge 18 slightly less than that of the bearing portion such that the bearing portion contacts the bottom of the carrier.

Figure 6:
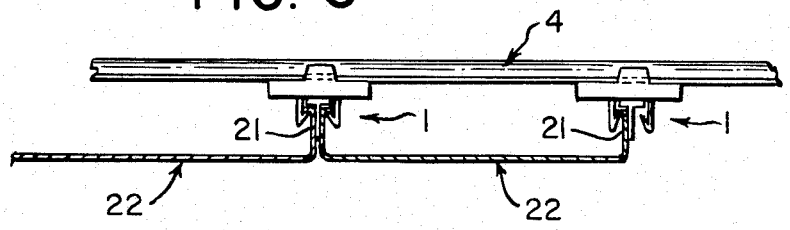
FIG. 6 is a cross-sectional view of U-shaped panels having horizontally extending inturned edges supported by a clip constructed according to the invention.

The clip construction preferably includes two intermediate resilient or elastic flanges 20 mounted on the panel engaging part in a plane midway between the hook means 8. These flanges serve as resilient stops to assure that inturned edges 21 forming the longitudinal rims of panels 22 as shown in FIG. 6 will be securely held in place on the hook means 8.

As shown in FIG. 5 the hook means 8 have inwardly slanted or inclined barbs 23. In the event that the edges or rims 21 are larger than normal, the rims will force the hook means 8 apart tending to move the inclined portions of the hooks to a more horizontal position to provide a support surface for the rims.

Figure 7:
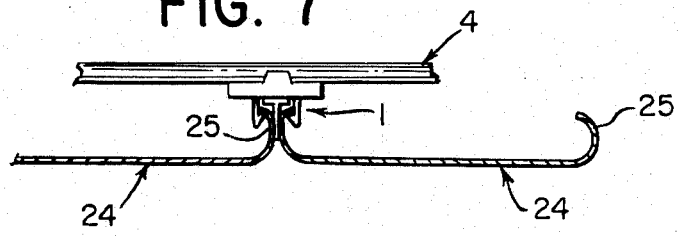
FIG. 7 is a view similar to FIG. 6 illustrating a further form of a panel construction secured by a clip constructed according to the invention.

The panels supported by the clips 1 may take other forms besides the ones shown in FIG. 5. Thus the clip may be used with panels 24 having rounded ends 25 terminating in an inturned edge as shown in FIG. 7.

Figure 8:
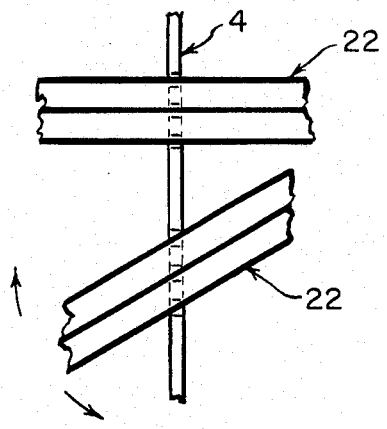
FIG. 8 is a schematic view of panels inclined at various angles with respect to a carrier.

The bearing portion of the clip allows the panel engaging part to be turned with respect to a carrier. As shown in FIG. 8 the clip may position panels 22 perpendicular to a carrier as shown in the top portion of FIG. 8 or at any angle with respect to a carrier as shown in the bottom portion of the figure. Thus it is seen that a clip according to the invention may be utilized to mount a panel on a carrier at a number of angular positions.

The base part may easily be interchanged with base parts of different size to accommodate various carrier configurations or sizes.

Referring to FIGS. 9–11 wherein parts identical to parts shown in FIGS. 1–3 have the same identification numerals, there is illustrated the clip construction of FIG. 1 having in addition a separate end panel engaging part in the form of an end panel clip adapter 100.

The end panel clip adapter 100 comprises an adapter body portion 101 having an upstanding fastener flange 102 and an upstanding resilient fastener hook member 103 each of which is adapted to extend through opening 3' in the part 3 when the part 3 does not engage a panel in the manner shown in FIGS. 6 or 7. Part 100 is assembled with part 3 by forcing the upstanding flange 102 and hook member 103 upwardly between hook means 8 carried on the part 3 until the barb 104 snaps over the edge of opening 3'. The body portion 101 has cutouts 105 therein to receive flanges 20 of the part 3 so that the parts 100 and 3 may be pressed into close contact with each other.

The clip adapter has flanges 107 at one end thereof and a resilient hook member 108 spaced from and positioned inwardly of flanges 107 to receive the rim 109 of an end panel 110 as shown in FIG. 11. This positioning of the flanges 107 on the end of the body portion 101 results in only the flanges of the clip construction extending beyond the end of the end panel 110. Thus the end panel may be positioned close to a side wall, not shown, so that there is only a small gap between the wall and end panel determined by the width of the flanges 107. This construction of the end panel adapter clip presents a smooth appearance for the end of the end panel even when it stands apart from any wall since all of the clip construction, with the exception of the flanges 107, will be masked off from view or covered by the end panel.

Referring to FIGS. 12–14 where again parts identical to parts shown in FIGS. 1–3 have the same identification numerals, there is illustrated a clip construction by which the distance between adjacent panels may be positioned to provide an even module positioning of a plurality of adjacent panels.

As shown the clip construction utilizes the base part 2 of the previously described embodiments to which is added panel engaging part 200. Panel engaging part 200 has a body portion 201 having a lower shelf 202 connected by side walls 203 to the body portion 201. Two oppositely disposed upstanding elastic support means 205 extend upwardly from the shelf 202 to extend over the edges of aperture 10 in the base part 2 and serve to rotatably suspend the body portion 201 from the base part 2. Upstanding parts 206 which engage the sides of the aperture 10 further serve to guide the body portion 201 for rotational movement with respect to the base portion.

The body portion 201 has two parallel extending elastic hook members 210 spaced at opposite ends of the body 201 and four intermediate flanges 211 spaced inwardly from the hook members. As shown in FIG. 14 the flanges 211 cooperate with hook members 210 to support longitudinal rims 109 of panels 110.

The distance between the hook members 210, usually on the order of $\frac{7}{8}''$, provides the spacing between adjacent panels to assure that the panel interval spacing is an even module, especially if the panels are of a conventional width of $3\frac{1}{8}''$, $5\frac{1}{8}''$ or $7\frac{1}{8}''$.

In the form of the invention illustrated in FIGS. 9–14, it is important to note that the panels do not have to be mounted perpendicular with respect to the carrier 4 since the panel engaging members are rotational with respect to the base members in turn mounted on the carriers.

I claim:

1. Panel installation clip for fastening panels having longitudinal rims thereon to a carrier, characterized in that said clip comprises a base part adapted to be engaged with and supported from a carrier and a panel engaging part having thereon a bearing portion rotatably engaging a surface of said base and supporting said panel engaging part on said base part, hook means for connecting said base part to said carrier and for retaining said bearing portion of the panel engaging part on said base part against removal therefrom independently of the engagement of the base part with the carrier, said panel engaging part having means adapted to retain at least one longitudinal rim of adjacent panels.

2. Panel installation clip for fastening panels having longitudinal rims thereon to a carrier, characterized in that said clip comprises a base part adapted to be engaged with and supported from a carrier and a panel engaging part rotatably supported from said base part and adapted to retain longitudinal rims of adjacent panels, said panel engaging part having thereon a bearing portion rotatably engaging a surface of said base part and supporting said panel engaging part on said base part, and said base part having upstanding edges surrounding said bearing portion and being of a height substantially equal to that of said bearing portion whereby when said clip is applied to a carrier, any play between said panel engaging part and said carrier in a direction parallel to the axis of rotation of said panel engaging part is substantially eliminated.

3. Panel installation clip for fastening panels having longitudinal rims thereon to a carrier, characterized in that said clip comprises a base part adapted to be engaged with and supported from a carrier and a panel engaging part rotatably supported from said base part and adapted to retain longitudinal rims of adjacent panels, said panel engaging part having thereon a bearing portion rotatably engaging a surface of said base part and supporting said panel engaging part on said base part and said base part having oppositely projecting spaced resilient hook members adapted to engage opposite flanges of a carrier and between which hook members the bearing portion of the panel engaging part is snap-fitted into place on said base part.

4. Panel installation clip for fastening panels having longitudinal rims thereon to a carrier, characterized in that said clip comprises a base part adapted to be engaged with and supported from a carrier and a panel engaging part rotatably supported from said base part and adapted to retain at least one longitudinal rim of adjacent panels, said panel engaging part having thereon a bearing portion rotatably engaging a surface of said base part and supporting said panel engaging part on said base part, said base part having an aperture therein, and said panel engaging part having an elastic hook means connecting with said bearing portion and extending through said aperture adapted to connect with and support said longitudinal rim of the panel.

5. Panel installation clip according to claim 4 further characterized in that said hook means has an intermediate flange associated therewith with said intermediate flange adapted to lock a longitudinal rim of a panel between it and a hook means.

6. Panel installation clip according to claim 5 wherein said intermediate flange is elastic whereby said flange may be bent sideways on application of pressure by a longitudinal rim of a panel inserted between the flange and an elastic hook means to provide an additional locking force on the rim.

7. Panel installation clip according to claim 5 wherein said elastic hook means includes an upwardly inclined barb adapted to engage the edge of a longitudinal rim and which when engaged with a rim of larger than normal size may bend so that the initial barb approaches a horizontal panel.

8. Panel installation clip according to claim 5 further characterized in that said hook means comprises two spaced oppositely disposed hooks with at least one said intermediate flange being positioned in a plane extending midway between said hooks.

9. Panel installation clip for fastening panels having longitudinal rims thereon to a carrier, characterized in that said clip comprises a base part adapted to be engaged with and supported from a carrier and a panel engaging part rotatably supported from said base part and adapted to retain longitudinal rims of adjacent panels, said base part having an aperture therein and said panel engaging part having oppositely disposed elastic support means extending through said aperture and engaging over the edges thereof to rotatably support said panel engaging part with respect to said base part.

10. Panel installation clip according to claim 9 wherein said panel engaging part has two spaced flanges extending parallel and in an opposite direction from said support means, and two parallel extending elastic hook means spaced outwardly of said flanges and in an opposite direction of said support means with each said hook means being associated with a flange and adapted to connect with and support therebetween a longitudinal rim of a panel.

11. Panel installation clip for fastening panels having longitudinal rims thereon to a carrier, characterized in that said clip comprises a base part adapted to be engaged with and supported from a carrier and a panel engaging part rotatably supported from said base part and adapted to retain longitudinal rims of adjacent panels, and an end panel clip adapted connected to said panel engaging part when said panel engaging part does not retain longitudinal rims of adjacent panels and wherein said end panel clip adapter is adapted to be connected to a longitudinal rim of an end panel of a plurality of adjacent panels, said end panel clip adapter having a flange on one end thereof and a resilient hook member extending parallel and spaced from said flange adapter to connect and support therebetween a longitudinal rim of said end panel.

* * * * *